US011865403B2

(12) United States Patent
Magrella

(10) Patent No.: US 11,865,403 B2
(45) Date of Patent: Jan. 9, 2024

(54) PILATES AND BARRE WORKOUT AND STORAGE DEVICE

(71) Applicant: Pazia Life by Design, LLC, Lake Worth, FL (US)

(72) Inventor: Jean Magrella, Lake Worth, FL (US)

(73) Assignee: Pazia Life By Design, LLC, Lake Worth, FL (US)

( * ) Notice: Subject to any disclaimer, the term of this patent is extended or adjusted under 35 U.S.C. 154(b) by 0 days.

(21) Appl. No.: 17/653,203

(22) Filed: Mar. 2, 2022

(65) Prior Publication Data

US 2022/0280831 A1 Sep. 8, 2022

Related U.S. Application Data

(60) Provisional application No. 63/155,380, filed on Mar. 2, 2021.

(51) Int. Cl.

| | |
|---|---|
| ***A63B 21/00*** | (2006.01) |
| ***A63B 71/00*** | (2006.01) |
| ***A63B 21/002*** | (2006.01) |

(52) U.S. Cl.

CPC ..... *A63B 21/4033* (2015.10); *A63B 21/0023* (2013.01); *A63B 71/0036* (2013.01)

(58) Field of Classification Search

CPC ..... A63B 21/00047; A63B 21/00178; A63B 21/4027; A63B 21/4029; A63B 21/4031; A63B 21/4039; A63B 71/0036

See application file for complete search history.

(56) References Cited

U.S. PATENT DOCUMENTS

| | | | | |
|---|---|---|---|---|
| 5,277,684 | A | 1/1994 | Harris | |
| 5,681,249 | A * | 10/1997 | Endelman | A63B 21/154 482/133 |
| 5,997,442 | A * | 12/1999 | Cordes | A63B 21/072 482/52 |
| 6,220,995 | B1 | 4/2001 | Chen | |
| 7,311,642 | B2 * | 12/2007 | Li | A63B 23/0458 482/142 |
| 9,474,922 | B2 | 10/2016 | Magrella | |
| 9,770,618 | B2 * | 9/2017 | Wall | A63B 21/0557 |
| 10,646,743 | B2 * | 5/2020 | Miller | A61G 13/105 |
| 10,960,256 | B2 * | 3/2021 | Donnelly | A63B 21/4029 |
| 2009/0105054 | A1 | 4/2009 | Boland et al. | |
| 2009/0227434 | A1 | 9/2009 | Baudhuin | |
| 2009/0264266 | A1 | 10/2009 | Solow et al. | |

* cited by examiner

*Primary Examiner* — Loan B Jimenez
*Assistant Examiner* — Zachary T Moore
(74) *Attorney, Agent, or Firm* — McHale & Slavin, P.A.

(57) ABSTRACT

A compact, movable, decorative exercise and storage device configured to allow a user to perform Pilates exercises and Ballet Barre (Barre) exercises. The exercise and storage device may include an upper portion and a lower portion and is traversable between a first use configuration and a second use configuration.

18 Claims, 14 Drawing Sheets

PILATES AND BARRE WORKOUT AND STORAGE DEVICE

CROSS REFERENCE TO RELATED APPLICATIONS

In accordance with 37 C.F.R. 1.76, a claim of priority is included in an Application Data Sheet filed concurrently herewith. Accordingly, the present invention claims priority to U.S. Provisional Patent Application No. 63/155,380, entitled "PILATES AND BARRE WORKOUT AND STORAGE DEVICE", filed Mar. 2, 2021. The contents of the above referenced application are incorporated herein by reference in their entirety.

FIELD OF THE INVENTION

The present invention is directed towards exercise equipment; to exercise equipment directed to the field of Pilates and Ballet Barre (Barre) procedures; and more particularly, to a combination Pilates-Barre device that can be used to perform both Pilates and Barre exercises.

BACKGROUND OF THE INVENTION

Pilates is currently a popular physical fitness system employing many exercise movements. The method was designed to allow users the ability to develop controlled movement from a strong core using a range of apparatus/exercises to guide and train the body. Typical Pilates equipment may include a reformer, a horizontally positioned frame having a movable carriage. Reformers are designed to allow a user to perform a variety of exercises. Reformers are typically large, hard to move, and are oriented in a horizontal manner, which requires large amounts of open space.

To enhance the Pilates experience, combination exercises or routines have been developed. For example, Barre exercises, movements using a Ballet Barre, integrate a fat-burning format of interval training with muscle-shaping isometrics to quickly and safely reshape the entire body. The exercises are designed to help strengthen muscles, increase extension, improve flexibility, and help with balance. Combining Pilates exercises with Barre exercises provides an effective exercise regimen which may be more beneficial to a user than doing Pilates or Barre exercises alone. As such, equipment designed to allow users the capability to perform both Pilates type exercises and Barre type exercises is beneficial.

SUMMARY OF THE INVENTION

The present invention is directed towards a compact, movable exercise and storage device configured for allowing a user to perform Pilates exercises and Ballet Barre (Barre) exercises. The exercise and storage device may include an upper portion and a lower portion, and is traversable between a first use configuration and a second use configuration.

Accordingly, it is an objective of the present invention to provide an exercise equipment apparatus and storage unit designed to allow a user to perform multiple exercises.

It is a further objective of the invention to provide an exercise equipment apparatus and storage unit designed to allow a user to perform Pilates exercises.

It is yet another objective of the invention to provide an exercise equipment apparatus and storage unit designed to allow a user to perform Barre exercises.

It is a still further objective of the invention to provide an exercise equipment apparatus and storage unit designed to allow a user to perform Pilates and Barre exercises using a single apparatus.

Other objectives and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION OF THE INVENTION

Figure 1:
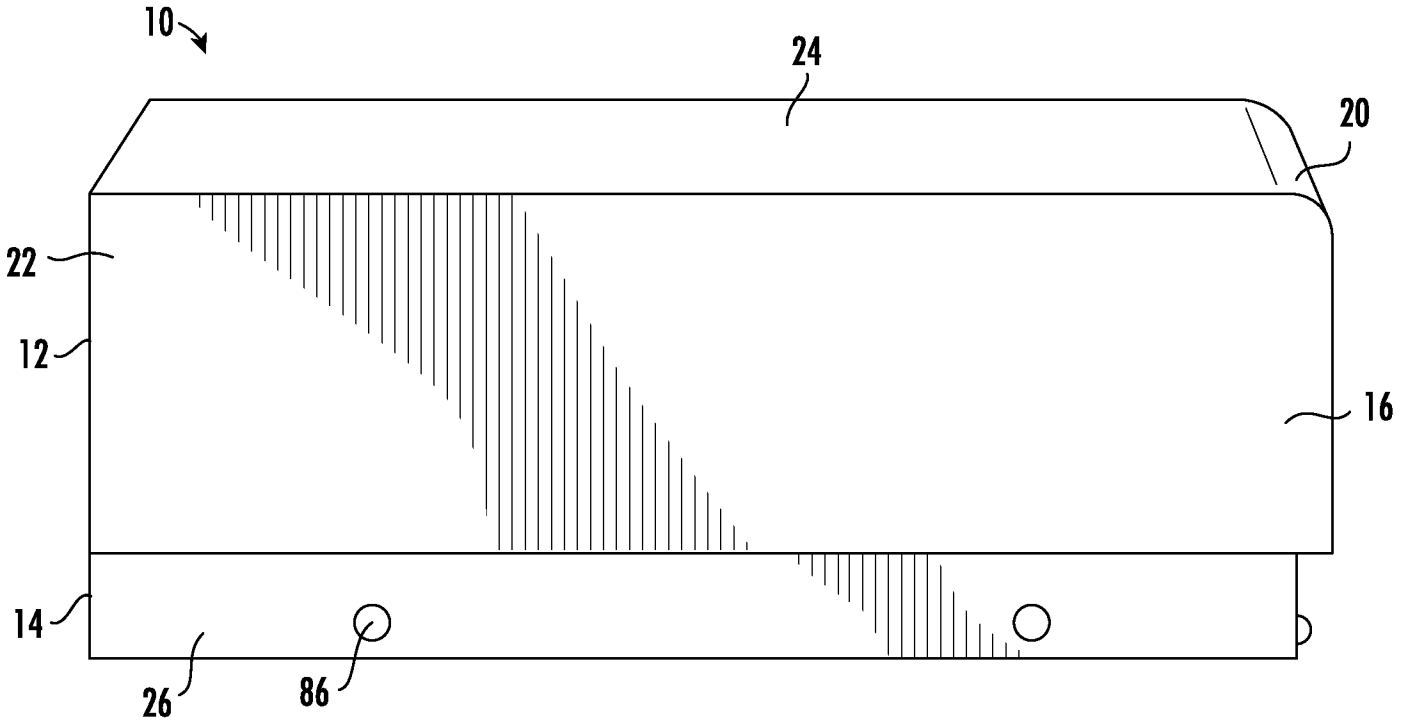
FIG. 1 is a side view of an illustrative embodiment of a Pilates-Barre exercise and storage device, shown in a first use position.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Figure 2:
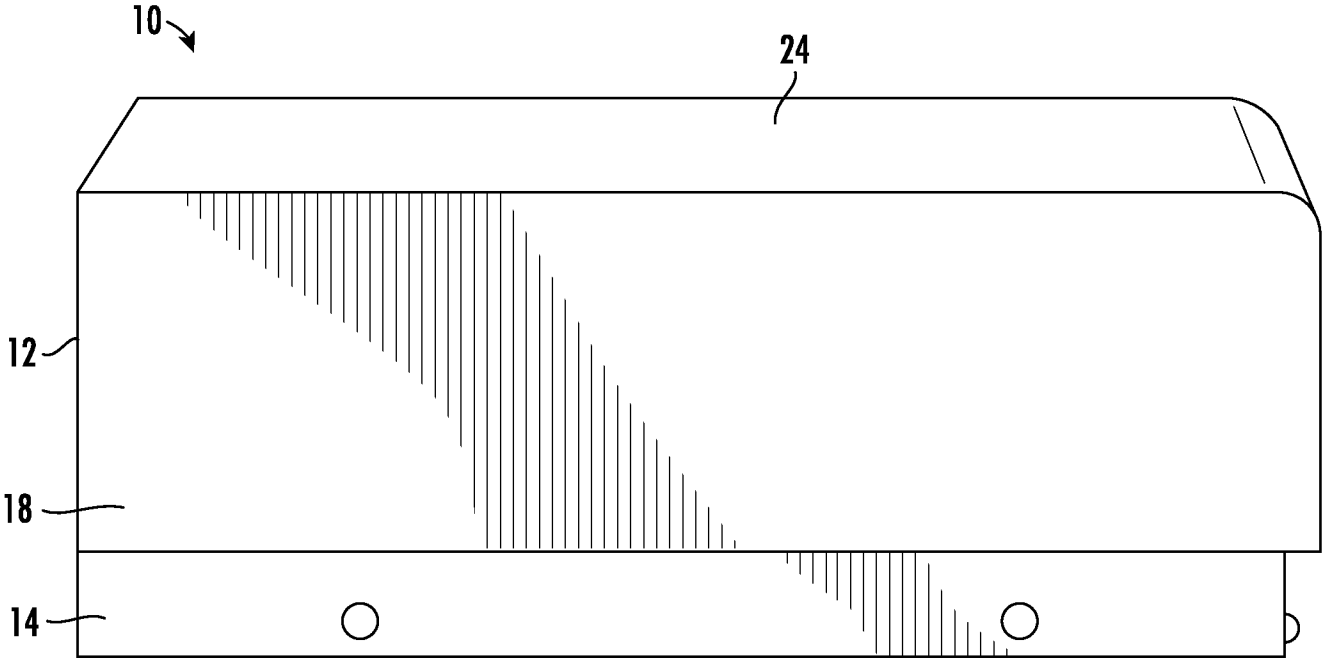
FIG. 2 is an alternative side view of the Pilates-Barre exercise and storage device, shown in a first use position.

Referring to FIGS. 1 and 2, an illustrative embodiment of a decorative exercise device with storage, which is configured for allowing a user to perform Pilates exercises and Barre exercises, referred to generally as a Pilates-Barre combination apparatus 10, is shown. The Pilates-Barre combination apparatus 10 is designed to be movable so a user can position the device in a first area, and easily move it to a second or third area. The Pilates-Barre combination apparatus 10 is configured to traverse between two positions: a first use position and a second use position. The Pilates-Barre combination apparatus 10 illustrated in FIGS. 1 and 2 is shown in the first use position. The Pilates-Barre combination apparatus 10 illustrated in FIGS. 5-11 is shown in the second use position. The second use position is configured to allow for Barre exercises.

Referring to FIGS. 1 and 2, the Pilates-Barre combination apparatus 10 comprises an upper portion 12 and a lower portion 14. The upper portion 12 and the lower portion 14 are configured to be separated. When in a non-separated position, i.e., when the upper portion 12 rests or is positioned on top of the lower portion 14, the Pilates-Barre combination apparatus 10 may be defined by a first side or surface 16, a second opposing side or surface 18, a front side or surface 20, a back side or surface 22, a top side or surface 24, and a bottom side or surface 26. The upper portion 12 and the lower portion 14 may be made of any suitable material, such as wood, plastic, and may be made with decorative material, such as leather. The upper portion 12 may include other materials, or combinations thereof, useful for its intended use or purpose, such as cushioning materials. Regardless of the material used, when in the first use configuration, the Pilates-Barre combination apparatus 10 allows a user to engage with the upper portion 12 or the lower portion 14 for use with one or more Pilates exercises or Pilates movements.

Figure 3A:
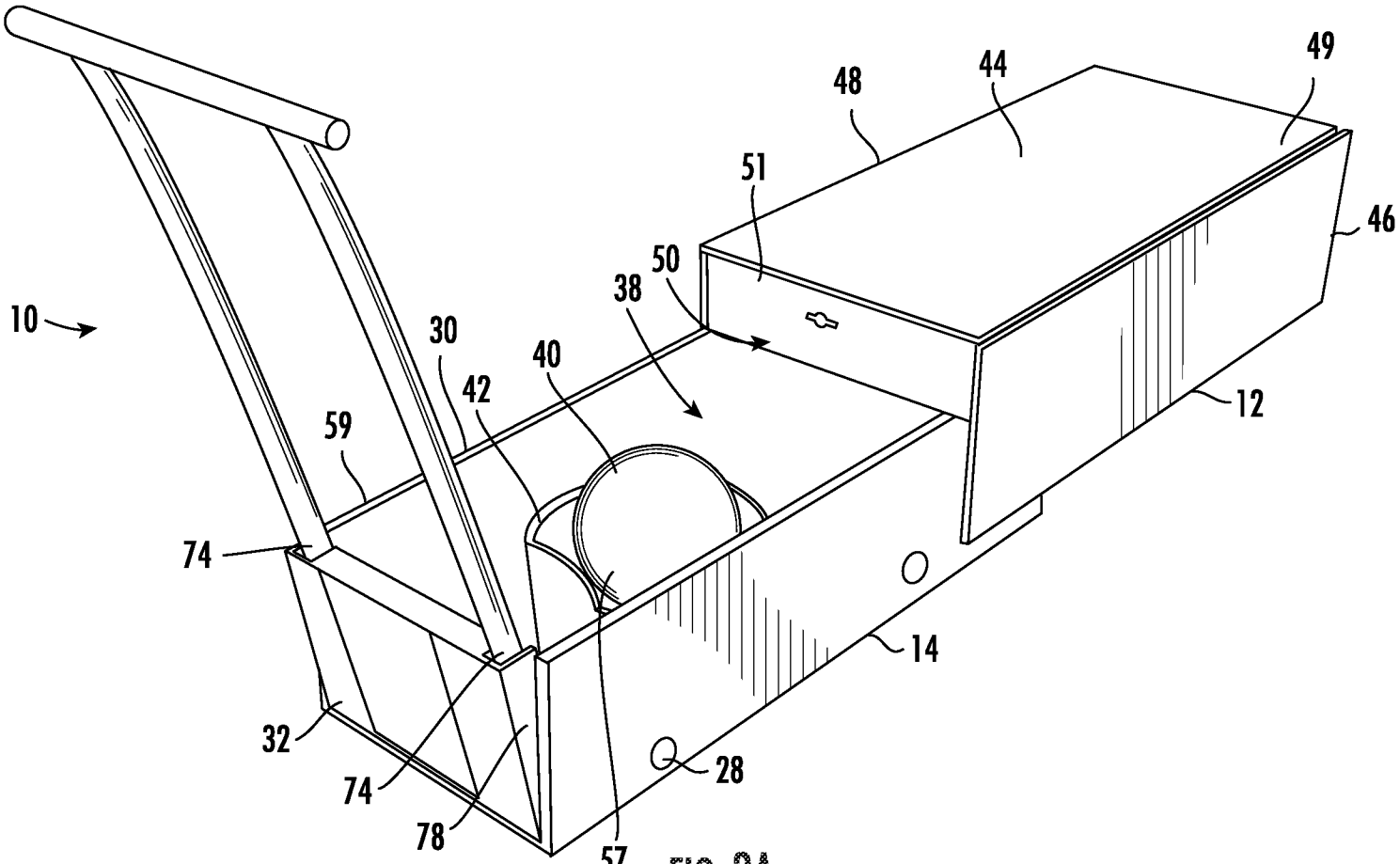
FIG. 3A is a perspective view of the Pilates-Barre exercise and storage device shown with the top portion partially removed from the bottom portion.
Figure 4:
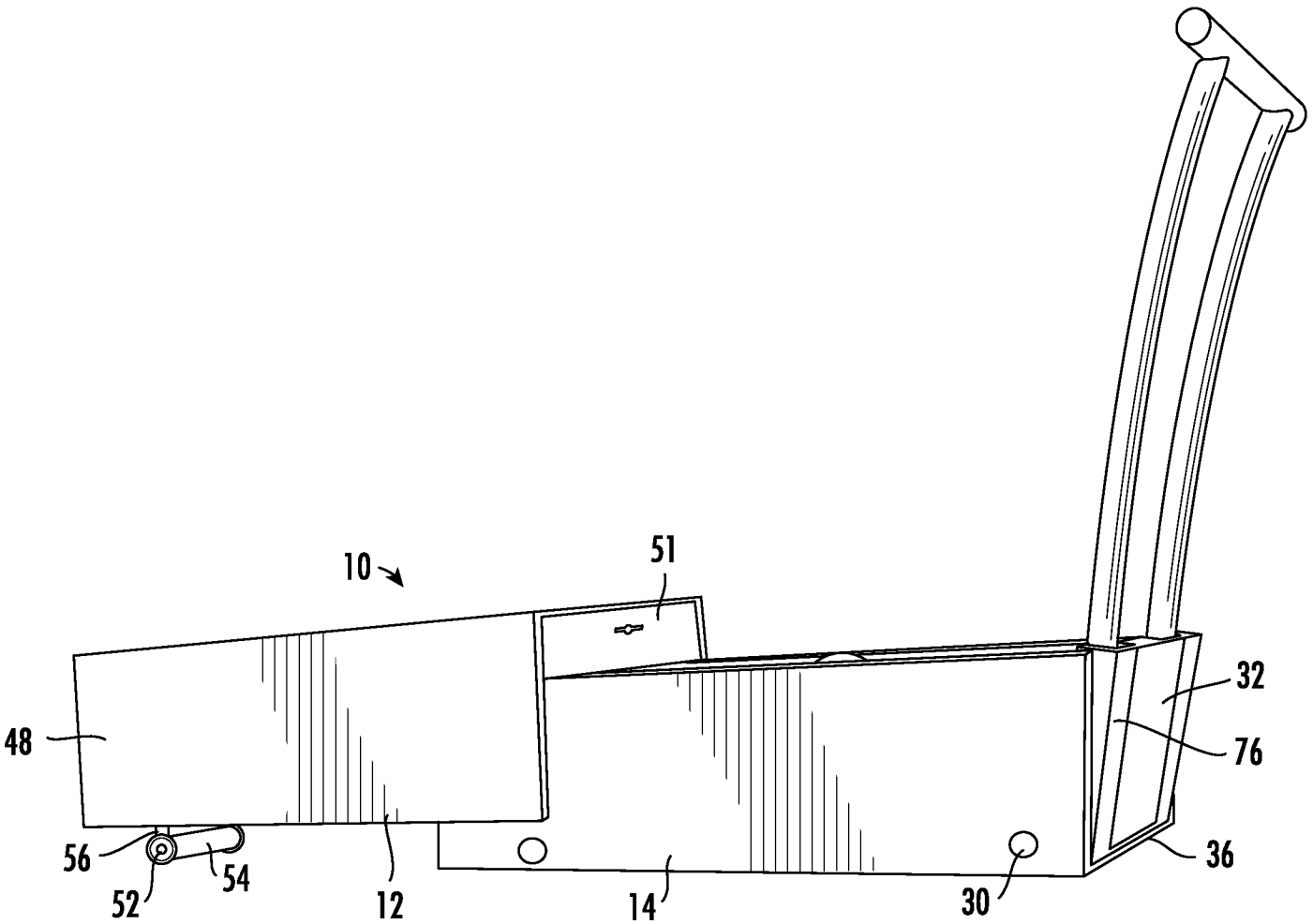
FIG. 4 is an alternative perspective view of the Pilates-Barre exercise and storage device, with the top portion partially removed from the bottom portion.
Figure 5:
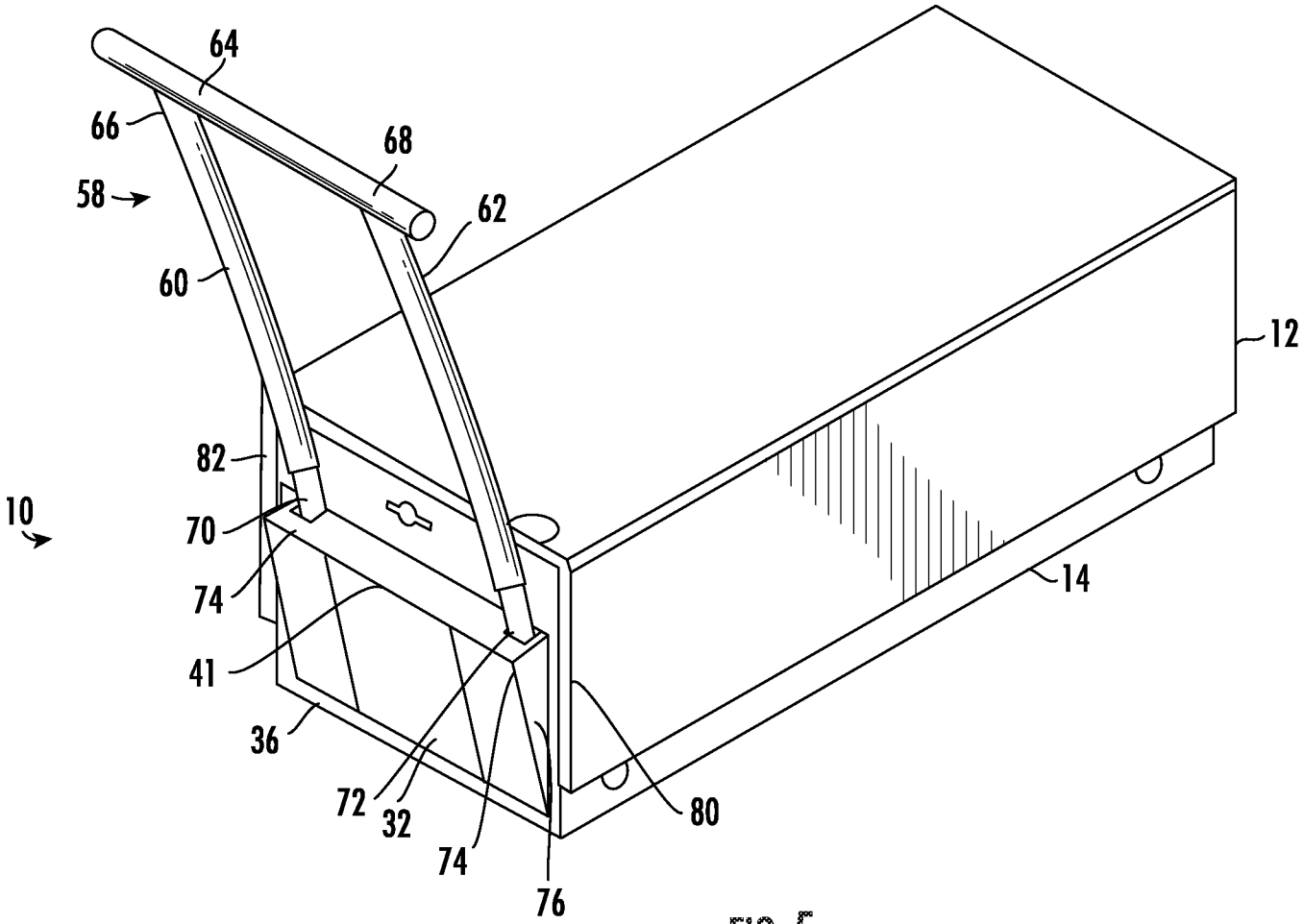
FIG. 5 is a perspective view of the Pilates-Barre exercise and storage device, shown in a second use position.

Referring to FIGS. 3A and 4, the Pilates-Barre combination apparatus 10 is illustrated with the upper portion 12 and the lower portion 14 in a separated position or orientation. Preferably, the upper portion 12 separates from the lower portion 14 by moving or sliding the upper portion 12 linearly away from the lower portion 14. However, the Pilates-Barre combination apparatus 10 may be designed to allow the upper portion 12 to be lifted vertically away from the lower portion 14. The lower portion 14 may comprise two opposing side walls, 28 and 30, a front wall 32 and back wall 34, and bottom wall 36. The two opposing side walls, 28 and 30, the front wall 32 and the back wall 34 arranged together to partially (open top) enclose an interior region or area 38. The two opposing side walls, 28 and 30, the front wall 32 and the back wall 34 may be secured together using one or more fastening mechanisms, including mechanical devices such as screws or nails, or chemical substances, such as glue, known to one of skill in the art. Alternatively, the two opposing side walls, 28 and 30, the front wall 32 and the back wall 34 may be integrally formed.

The two opposing side walls 28 and 30 are spaced apart by the distance defined by the length of the front wall 32 or the back wall 34. The lower portion interior region or area 38 is preferably sized and shaped to receive and store therein one or more pieces of equipment. As shown in FIG. 3, an exercise ball 40, such as an Ugi ball, with a storage bracket or housing 42 is shown as an illustrative example of exercise equipment. The storage bracket or housing 42 may be independent units secured to the lower portion bottom wall 36. Alternatively, the storage bracket or housing 42 may be integrally formed as part of the lower portion bottom wall 36. Other types of exercise equipment may include: a weighted bean bag like ball used in Pilates exercises, a ring, a mat, barbells, a cushion, or a Pilates column or roller. Alternatively, the interior region or area 38 may be sized and shaped to hold and store an exercise equipment tray. The exercise equipment tray may have one or more compartments for storing the exercise equipment therein.

Figure 6:
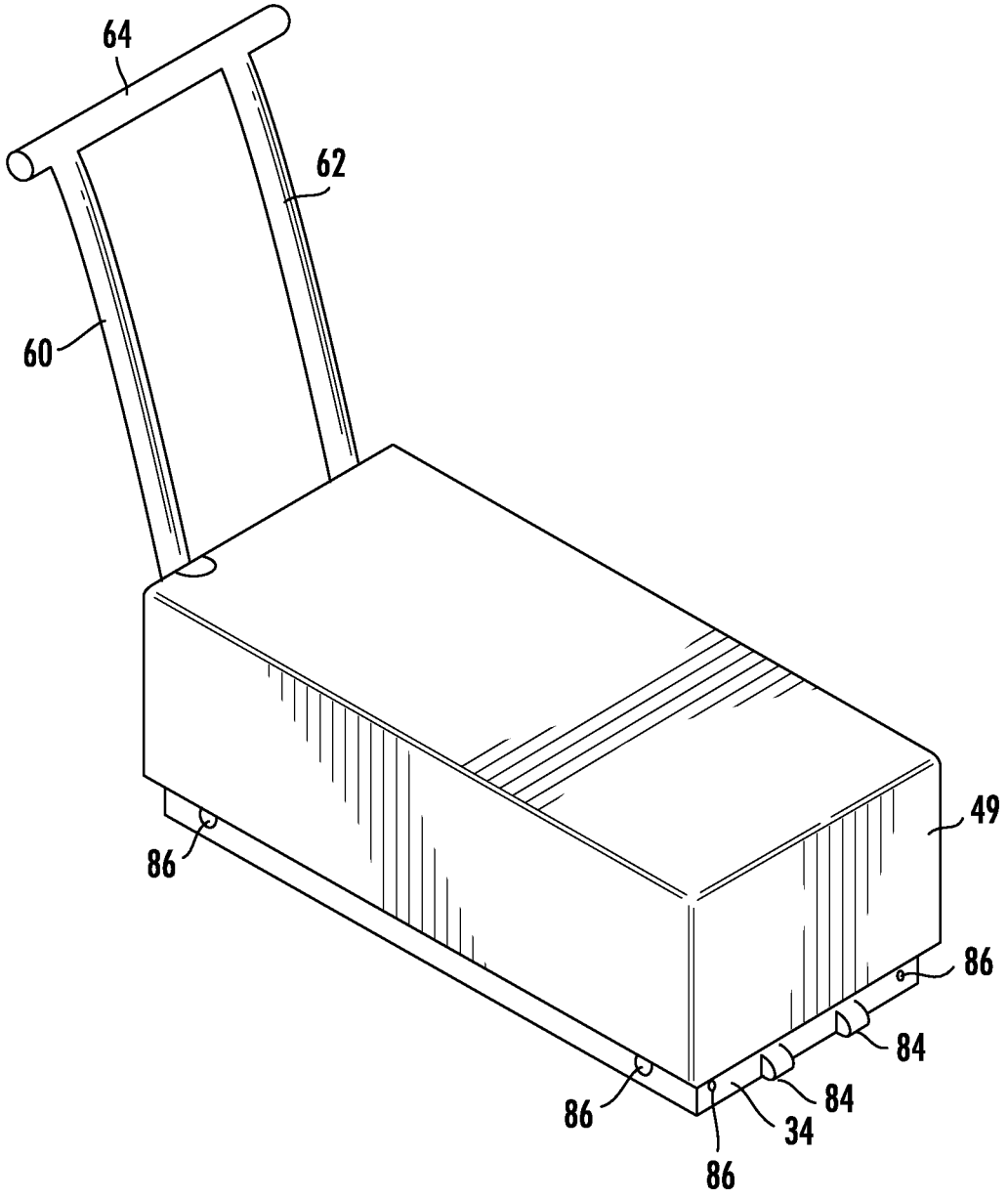
FIG. 6 is an alternative perspective view of the Pilates-Barre exercise and storage device, shown in a second use position.
Figure 7:
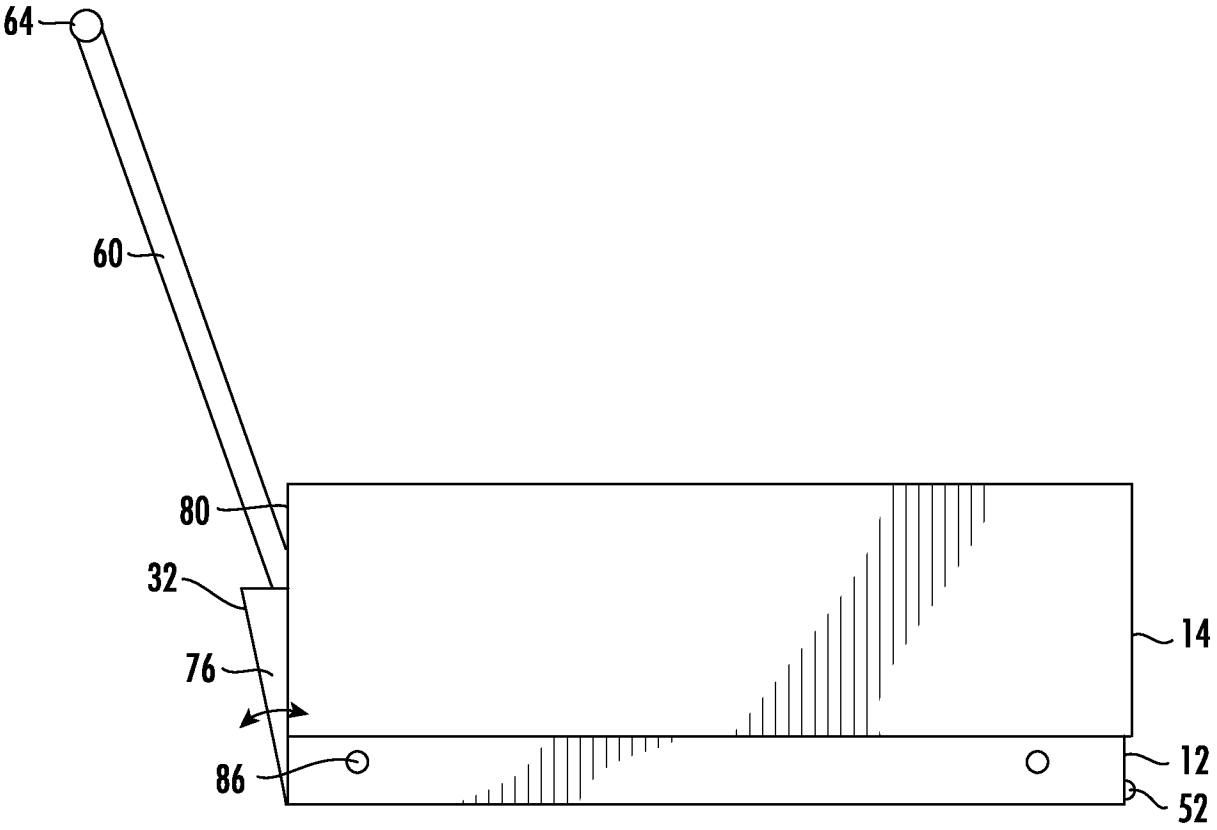
FIG. 7 is a left side view of the Pilates-Barre exercise and storage device shown in a second use position.
Figure 8:
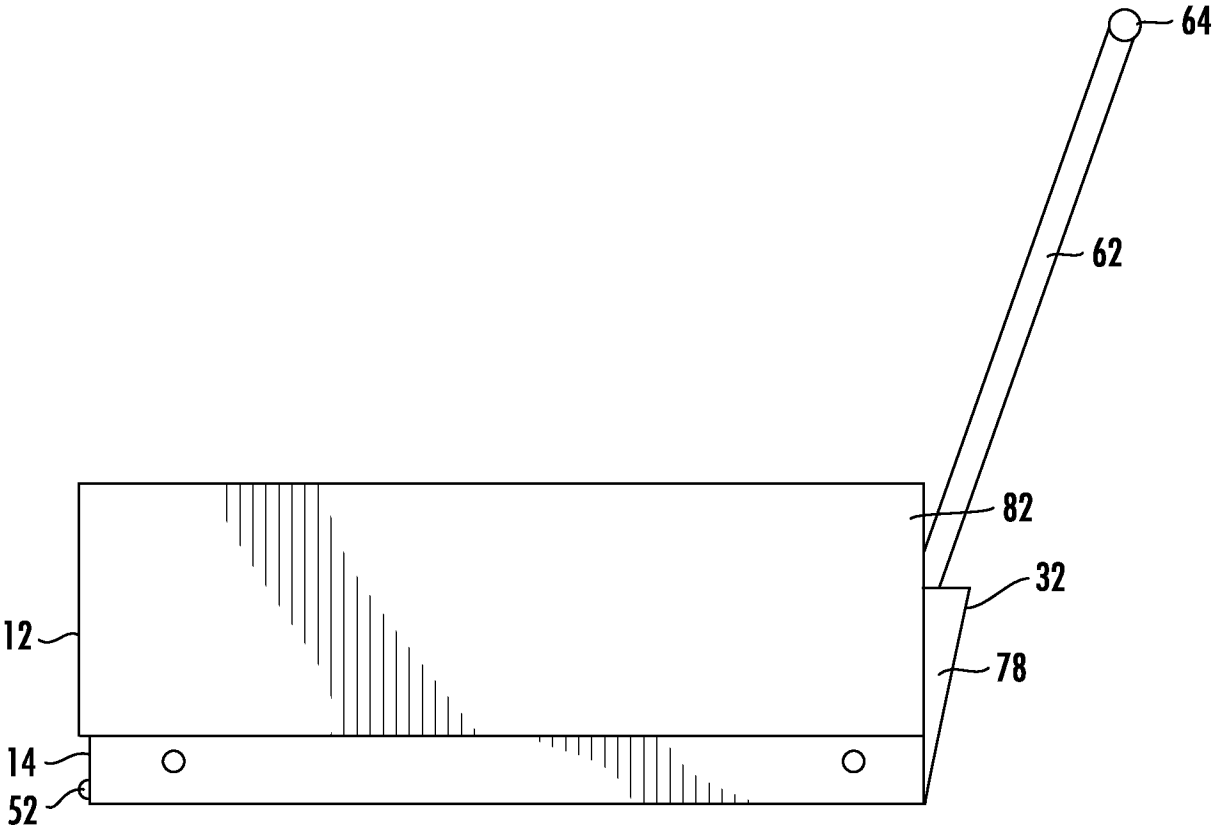
FIG. 8 is a right side view of the Pilates-Barre exercise and storage device shown in a second use position.
Figure 9:
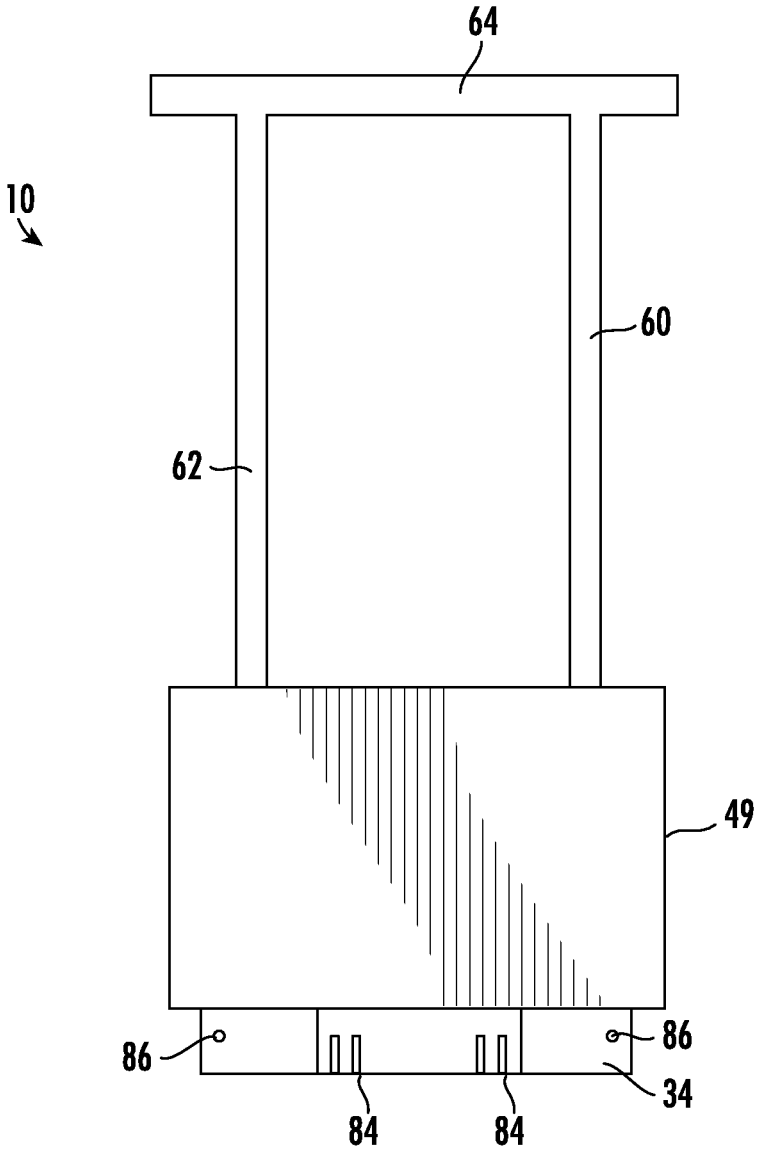
FIG. 9 is a front view of the Pilates-Barre exercise and storage device shown in a second use position.
Figure 10:
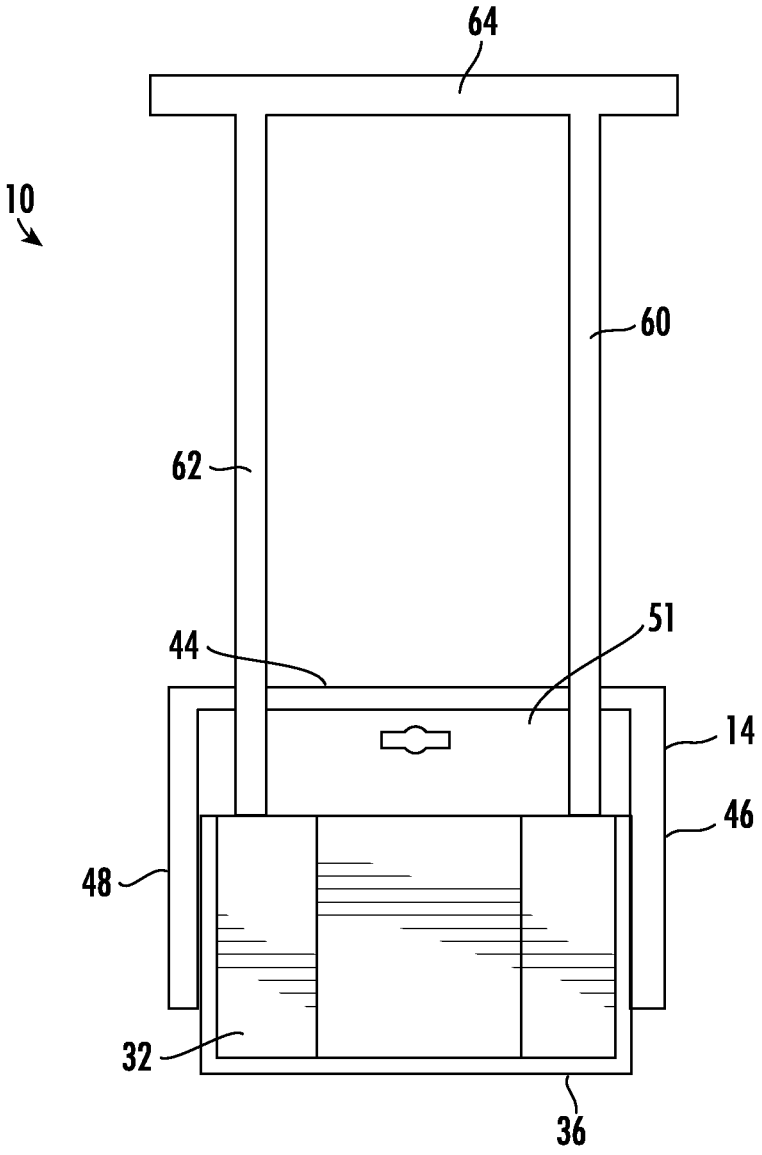
FIG. 10 is a back view of the Pilates-Barre exercise and storage device shown in a second use position.
Figure 11:
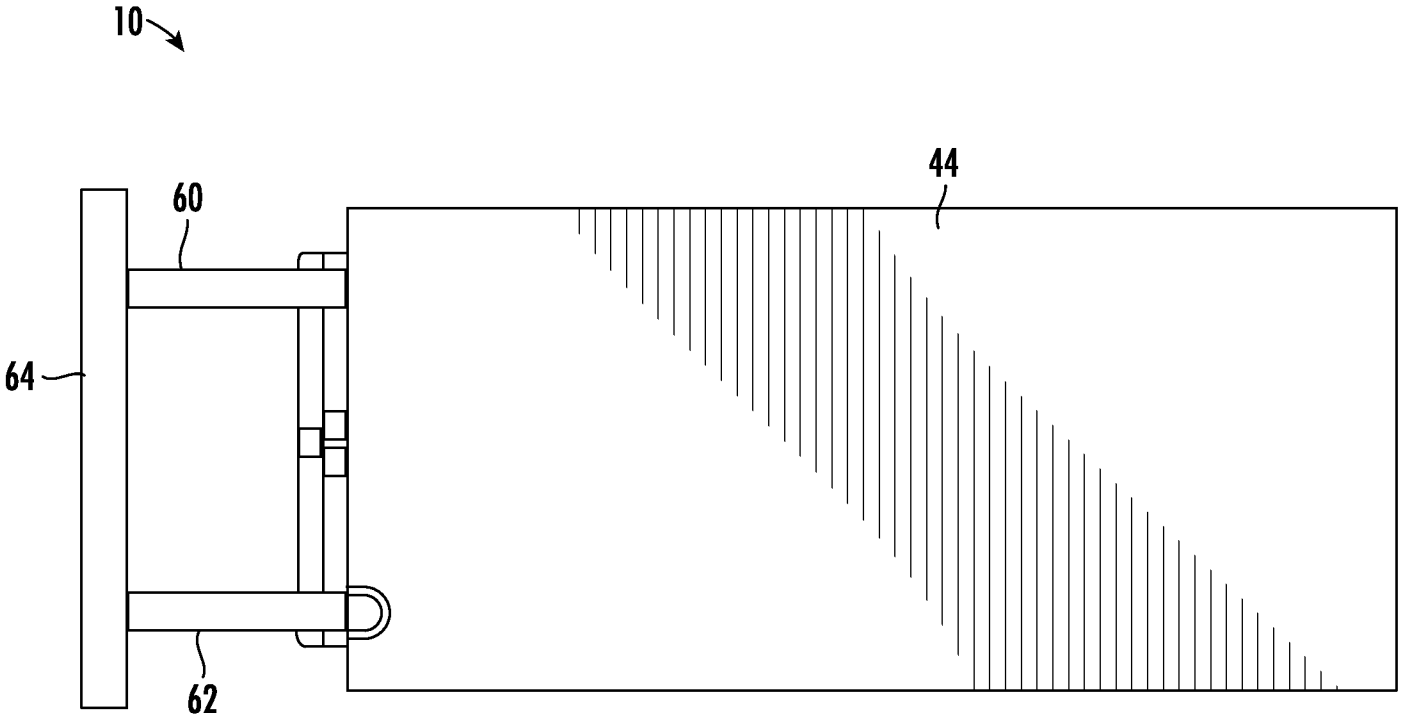
FIG. 11 is a top view of the Pilates-Barre exercise and storage device shown in a second use position.

The upper portion 12 may include an upper wall or surface 44 separating two opposing side walls, 46 and 48 (see FIG. 3A and FIG. 3C) and a back wall 49 (see also FIG. 6). The upper portion side walls 46 and 48 are arranged to extend away, in a downward direction from the upper wall or surface 44. The upper wall or surface 44 and the two opposing side walls 46 and 48, and back wall 49 may be secured together using one or more fastening mechanisms, including mechanical devices such as screws or nails, or chemical substances, such as glue, known to one of skill in the art. Alternatively, the upper wall or surface 44 and the two opposing side walls 46 and 48, and back wall 49 may be integrally formed. The upper wall or surface 44 and the opposing side walls 46 and 48 are arranged together to form an interior region or area 50. The upper portion interior region or area 50 is of sufficient size and shape to receive or allow the lower portion 14 to fit or move within. Accordingly, the distance between the upper portion side walls 46 and 48 is preferably larger than the distance between the lower portion side walls 28 and 30. Extending away from the upper wall or surface 44 is a wall or surface 51. The upper portion 14 may include a mechanism to provide movement, particularly movement along a surface in which the Pilates-Barre combination apparatus 10 or sits thereon, illustrated herein as wheels 52 and an axle 54, attached to the upper portion 14 by a bracket 56, see FIG. 4.

In the first use position, the upper portion upper wall or surface 44 is positioned or oriented to rest on or be placed above the lower portion side walls 28 and 30, front wall 32, and back wall 34, enclosing the lower portion interior region or area 38. In addition, the upper portion side walls 46 and 48 are aligned in a juxtaposition and in a parallel manner relative to the lower position side walls 28 and 38.

Figure 3B:
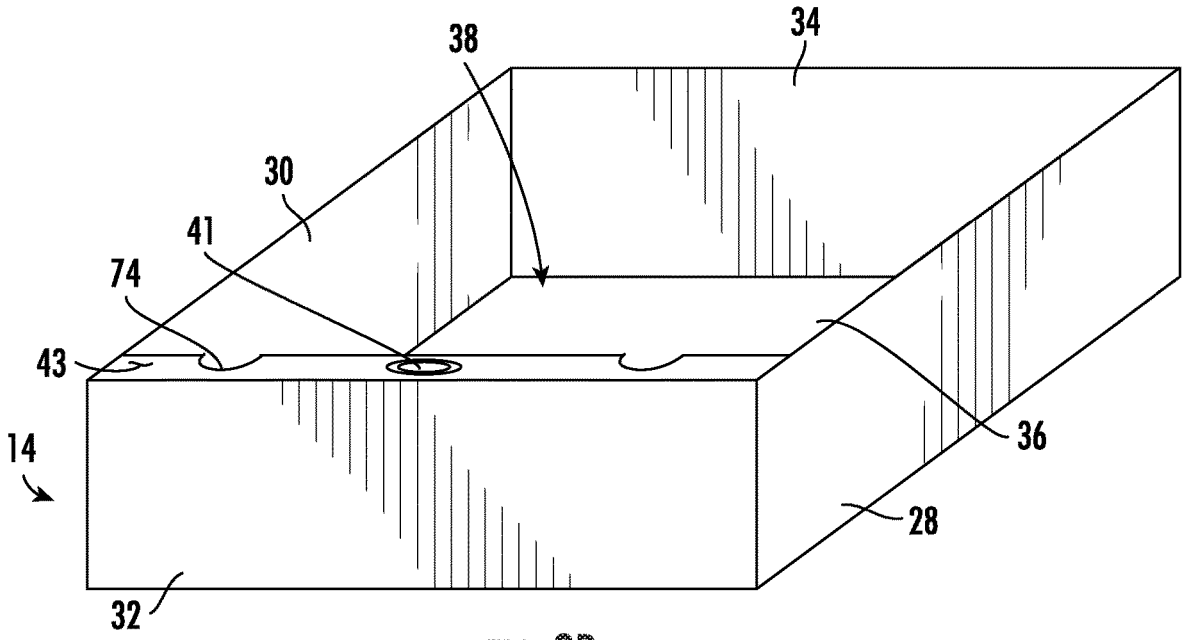
FIG. 3B illustrates an embodiment of a first member of an upper portion-lower portion locking member.
Figure 3C:
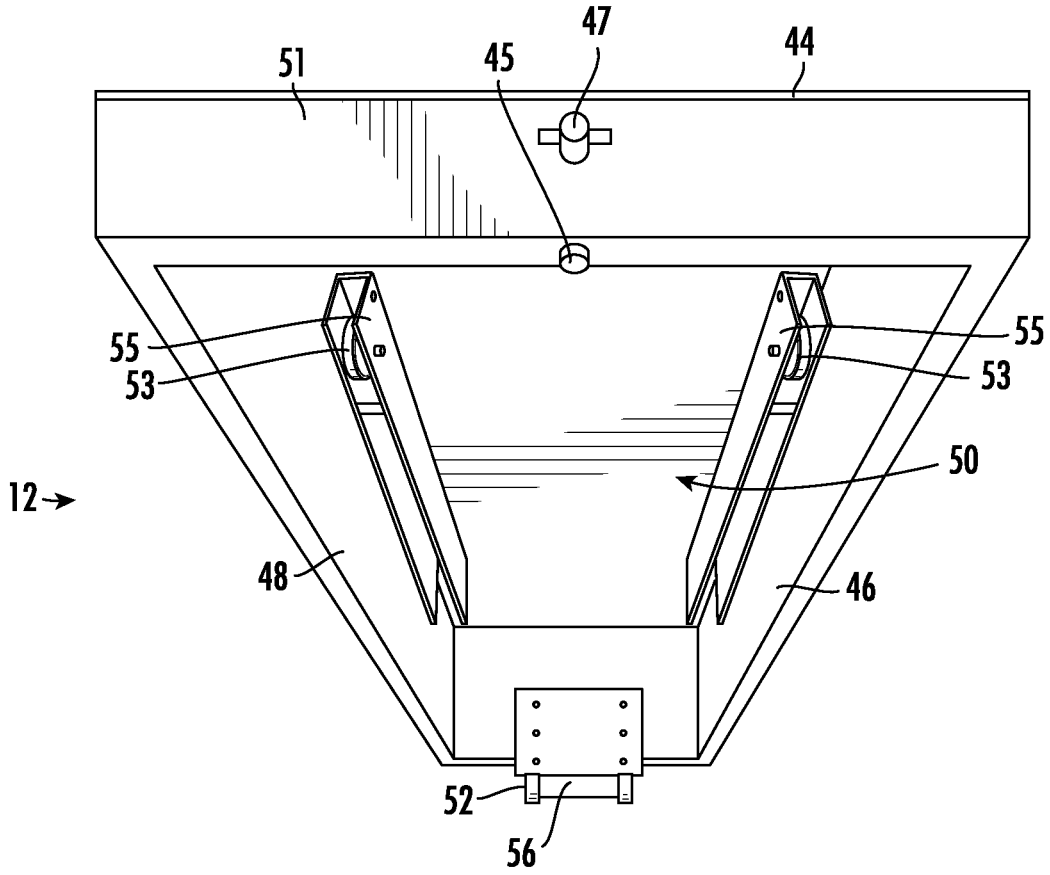
FIG. 3C illustrates an embodiment of a second member of the upper portion-lower portion locking member

The upper portion 12 may be locked (unlocked) to the lower portion 14. FIG. 3B illustrates an illustrates an embodiment of a first member of an upper portion-to-lower portion locking mechanism 41, illustrated herein as a recessed channel or notch. The first member of an upper portion-to-lower portion locking mechanism 41, is placed within an upper surface 43 of the lower portion front wall 32, and is sized and shaped to receive and secure to or lock with a second member of an upper portion-to-lower portion locking mechanism 45, illustrated herein as a protrusion extending out from the bottom of surface or wall 51, see FIG. 3C. The second member of the upper portion-to-lower portion locking mechanism 45 is sized and shaped to fit within, and secure to or lock with the first member of an upper portion-to-lower portion locking mechanism 41. A knob 47 operatively connects to the upper portion-to-lower portion locking mechanism 45. Turning the knob 47 may result in locking or unlocking positions. The interior 50 of the upper portion 12 may include wheels 53 secured to plates 55, this forming a guide or rail. The wheels 53 may be used to help move the upper portion 12 from the first position to the second position. The guide or rail allow the upper portion 12 to move about at least a portion if the lower portion 14, such as the upper surfaces of the 57, 59 walls 28 and 30.

Referring to FIGS. 5-11, the Pilates-Barre combination apparatus 10 is shown in the second use position. In this position, the Pilates-Barre combination apparatus 10 allows the user to perform Pilates exercises or Pilates movements and Barre exercises, or Barre movements. In the second configuration, the upper portion 12 is secured in a position on top of the lower portion 14. To aid a user in performing Barre exercises or Barre movements, a removable Barre exercise assembly structure 58 is provided (see FIG. 5). The Barre exercise assembly structure 58 may be made as a single unit. Alternatively, the Barre exercise assembly structure 58 may be made of multiple, individual components configured to fit or slide within each other so as to provide for height adjustability and/or ease or compactness for storage. The Barre exercise assembly structure 58 may comprise a first vertical structure 60, a second vertical structure 62 spaced apart from the first vertical structure 60, and an intermediate structure 64 connecting the first vertical structure and the second vertical structure 62. The intermediate structure 64 is shown herein as a cross bar secured or integrally formed to the top end 66 of the first vertical structure 60 and the top end 68 of the second vertical structure 62. The bottom end 70 of the first vertical structure 60 and the bottom end 72 of the second vertical structure 62 secure to openings 74 within the lower portion front wall 32. The intermediate structure, or cross bar, 64 is preferably sized and shaped to support a user when the user engages and holds at least a portion of it while performing Barre exercises. The cross bar 64 may include a foam or padded grip or material.

Figure 12:
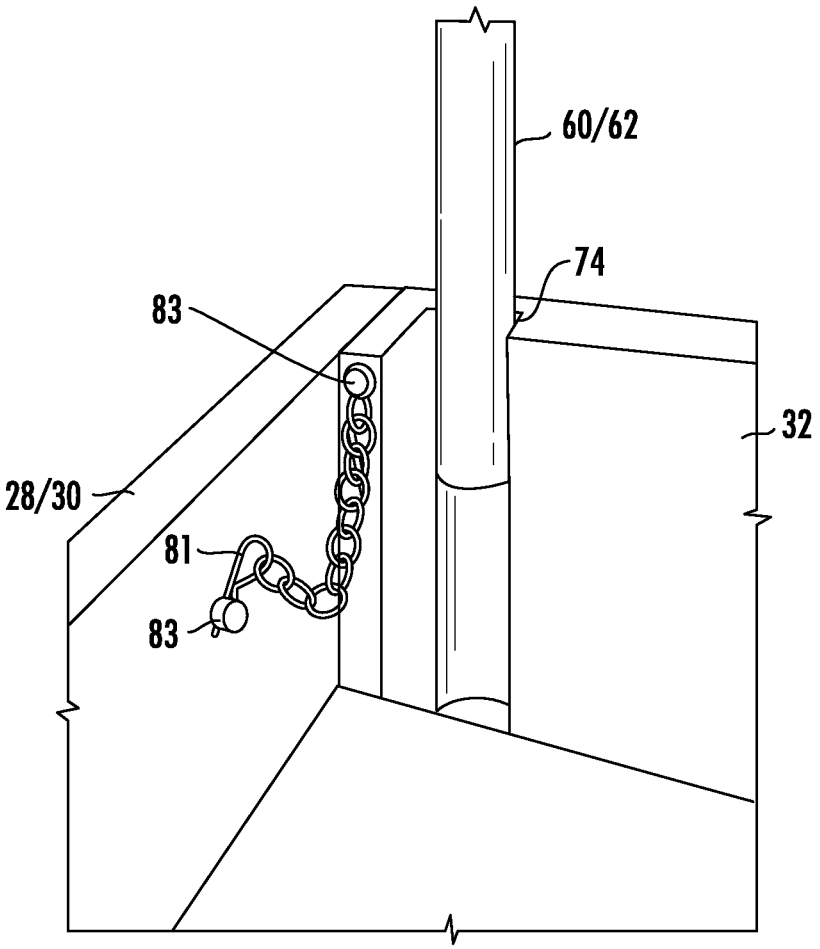
FIG. 12 illustrates the hinged connected of the lower portion front wall to the lower portion side wall and lower portion side wall via a chain.

The lower portion front wall 32 is preferably configured to traverse between a first lower portion position and second lower portion position; the second lower portion position being at an angle from the first lower portion position. The first lower portion position, as used herein, relates to the lower portion front wall 32 being arranged or oriented at a position which is perpendicular to (ninety degrees) and not separated from the lower portion side wall 28 and lower portion side wall 30, or the lower portion front wall 32 ends 76 and 78 (see FIGS. 3, 4 5, 7, and 8) are parallel with the lower portion side wall 28 end 80 and lower portion side wall 30 end 82 (see FIG. 5). The second lower portion position defines the arrangement or orientation of the lower portion front wall 32, which is separated from the lower portion side wall 28 and lower portion side wall 30 by an angle (less than ninety degree), or the lower portion front wall 32 ends 76 and 78 are not parallel (and angled) with the lower portion side wall 28 end 80 and the lower portion side wall 30 end 82. As such, the lower portion front wall 32 may be hingedly connected to the lower portion side wall 28 and lower portion side wall 30. Referring to FIG. 12, the lower portion front wall 32 is connected to the lower portion side walls 30 or 32 via a chain 81 and secured via screw or bolt. The bottom portion of the lower portion front wall 32 may be pivotably secured or connected to the lower portion of the lower portion side walls 30 or 32. When in the second lower portion position, the Barre exercise assembly structure 58 is positioned or orientated at an angle from the lower portion 14.

In use, the Pilates-Barre combination apparatus 10 is designed to allow a user the capability to perform Pilates exercises and Barre exercises. The upper surface 24 of the Pilates-Barre combination apparatus 10 is sized and shaped to allow the user to engage, i.e., sit, stand, or have at least some portion of the user's body resting thereon, in order to perform one or more of the Pilates exercises. To aid in the user's enjoyment or comfort when performing the Pilates exercises, the top wall may contain a pad, mat with padding, or a cushion secured to at least a portion of the upper surface 24. To increase the number of exercises a user can perform, the lower portion 14 may contain one or more equipment attachment units 84. The equipment attachment units 84 may be eyelets or other clasps or hooks designed to secure a secondary piece of exercise equipment, such as a resistance band, to the Pilates-Barre combination apparatus 10. The lower portion 14 may also include one or more openings or ports 86 sized to also receive secondary exercise equipment.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An exercise equipment and storage device designed to allow a user to perform multiple Pilates and Barre type exercises, comprising:

an upper member comprising a first side wall, a second side wall, an upper wall separating said first side wall and said second side wall and having an interior surface and an exterior surface, and a back wall, said first side wall, said second side wall, said upper wall, and said back wall arranged together to partially enclose an upper member interior, said upper wall interior surface comprising a first guide rail configured to engage with a first section of a lower member, and a second guide rail configured to engage with a second section of said lower member;

said lower member comprising a front wall, a back wall, a first side wall having an upper surface configured to slideably engage with said first guide rail, a second side wall having an upper surface configured to slideably engage with said second guide rail, and a bottom wall separating said first side wall and said second side wall, wherein, said front wall, said back wall, said bottom wall, said first side wall, and said second side wall are arranged together to partially enclose a lower member interior, said front wall movably attached to said first side wall and said second side wall, whereby said front wall is movable between a first position in which said front wall is positioned 90 degrees to a longitudinal axis of said lower member and a second position in which said front wall is positioned greater than 90 degrees to said lower member longitudinal axis, and, said upper member and said lower member configured to traverse between two positions, a first use position configured for use with Pilates exercises and a second use position configured for use with Barre exercises.

2. The exercise equipment and storage device designed to allow the user to perform multiple Pilates and Barre type exercises according to claim 1, wherein when orientated in said first use position or said second use position, at least a portion of said upper member rests on at least a portion of said lower member.

3. The exercise equipment and storage device designed to allow the user to perform multiple Pilates and Barre type exercises according to claim 1, wherein said upper member is movable about said lower member.

4. The exercise equipment and storage device designed to allow the user to perform multiple Pilates and Barre type exercises according to claim 1, wherein said first guide rail comprises one or more wheels configured to slidably engage with said first side wall upper surface, and said second guide rail comprises one or more wheels configured to slidably engage with said second side wall upper surface.

5. The exercise equipment and storage device designed to allow the user to perform multiple Pilates and Barre type exercises according to claim 1, wherein said upper portion member contains one or more wheels secured to said back wall.

6. The exercise equipment and storage device designed to allow the user to perform multiple Pilates and Barre type exercises according to claim 1, wherein said upper member separates from said lower member by moving or sliding said upper member linearly away from said lower member.

7. The exercise equipment and storage device designed to allow the user to perform multiple Pilates and Barre type exercises according to claim 1, wherein said lower member interior is sized and shaped to receive and store therein exercise equipment.

8. The exercise equipment and storage device designed to allow the user to perform multiple Pilates and Barre type exercises according to claim 1, wherein said lower member interior is sized and shaped to receive and store therein an exercise equipment storage bracket or housing.

9. The exercise equipment and storage device designed to allow the user to perform multiple Pilates and Barre type exercises according to claim 1, further including one or more equipment attachment units comprising a body configured to secure to one or more secondary exercise equipment.

10. The exercise equipment and storage device designed to allow the user to perform multiple Pilates and Barre type exercises according to claim 9, wherein said one or more equipment attachment units include eyelets, clasps, or hooks.

11. The exercise equipment and storage device designed to allow the user to perform multiple Pilates and Barre type exercises according to claim 1, further including one or more openings or ports configured to receive secondary exercise equipment.

12. The exercise equipment and storage device designed to allow the user to perform multiple Pilates and Barre type exercises according to claim 1, wherein said lower member includes openings configured to receive at least portions of a Barre exercise structure.

13. The exercise equipment and storage device designed to allow the user to perform multiple Pilates and Barre type exercises according to claim 1, wherein said lower member is configured to lock to said upper member.

14. The exercise equipment and storage device designed to allow the user to perform multiple Pilates and Barre type exercises according to claim 1, wherein said upper member is configured to lock to said lower member.

15. The exercise equipment and storage device designed to allow the user to perform multiple Pilates and Barre type exercises according to claim 1, wherein said lower member front wall is configured to receive a Barre exercise bar.

16. The exercise equipment and storage device designed to allow the user to perform multiple Pilates and Barre type exercises according to claim 1, wherein said lower member front wall comprises one or more openings or channels.

17. The exercise equipment and storage device designed to allow the user to perform multiple Pilates and Barre type exercises according to claim 1, further including a Barre exercise bar.

18. The exercise equipment and storage device designed to allow the user to perform multiple Pilates and Barre type exercises according to claim 17, wherein said Barre exercise bar comprises a first vertical structure, a second vertical structure, and an intermediate structure connecting said first vertical structure and said second vertical structure.

* * * * *